US008668634B2

(12) United States Patent
Wick

(10) Patent No.: US 8,668,634 B2
(45) Date of Patent: Mar. 11, 2014

(54) METHODS FOR REMEDIATING DRILL CUTTINGS AND OTHER PARTICULATE MATERIALS

(76) Inventor: Rod Wick, Calgary (CA)

( * ) Notice: Subject to any disclaimer, the term of this patent is extended or adjusted under 35 U.S.C. 154(b) by 0 days.

(21) Appl. No.: 13/620,262

(22) Filed: Sep. 14, 2012

(65) Prior Publication Data

US 2013/0012372 A1 Jan. 10, 2013

Related U.S. Application Data

(63) Continuation of application No. 12/052,634, filed on Mar. 20, 2008, now Pat. No. 8,287,441.

(60) Provisional application No. 60/896,818, filed on Mar. 23, 2007.

(51) Int. Cl.
*B04B 1/20* (2006.01)

(52) U.S. Cl.
USPC ..... 494/37; 494/13; 494/32; 494/53

(58) Field of Classification Search
USPC ..... 494/31–35, 43, 53, 54, 56, 13, 37; 366/146–147; 210/380.1, 380.3
See application file for complete search history.

(56) References Cited

U.S. PATENT DOCUMENTS

| | | | | |
|---|---|---|---|---|
| 581,354 | A | 4/1897 | Lapp | |
| 3,430,850 | A | 3/1969 | Gilreath | |
| 3,559,879 | A | 2/1971 | Bechard | |
| 3,561,930 | A | 2/1971 | Brown et al. | |
| 4,581,009 | A * | 4/1986 | Kramer | 494/37 |
| 4,781,671 | A * | 11/1988 | Pober et al. | 494/31 |
| 5,417,492 | A | 5/1995 | Christian et al. | |
| 5,547,277 | A | 8/1996 | Caspelherr et al. | |
| 5,882,524 | A | 3/1999 | Storey et al. | |
| 6,073,709 | A | 6/2000 | Hensley | |
| 6,177,014 | B1 | 1/2001 | Potter et al. | |
| 6,432,299 | B1 | 8/2002 | Hensley et al. | |
| 6,607,659 | B2 | 8/2003 | Hensley et al. | |
| 7,156,801 | B2 | 1/2007 | Dircks et al. | |
| 8,133,164 | B2 | 3/2012 | Beebe et al. | |
| 8,172,740 | B2 * | 5/2012 | El Dorry et al. | 494/8 |
| 8,287,441 | B2 * | 10/2012 | Wick | 494/13 |
| 8,528,665 | B2 * | 9/2013 | Jackson et al. | 494/31 |
| 2005/0202950 | A1 | 9/2005 | Dircks et al. | |

(Continued)

FOREIGN PATENT DOCUMENTS

WO 2013/071371 A1 * 2/2013

OTHER PUBLICATIONS

ALFA Laval Model 418 decanter centrifuge specification sheet and photos from http://www.marstechusa.com/NX418.html (at least as early as May 28, 1997).

*Primary Examiner* — Charles E Cooley
(74) *Attorney, Agent, or Firm* — Oyen Wiggs Green & Mutala LLP

(57) ABSTRACT

Methods for separating liquids, such as oils from solids, such as drill cuttings, apply a centrifuge to process a solids-enriched output of a fluids/solid separation device. The centrifuge may be a horizontal decanter-type centrifuge. The output may be heated. In example implementations the centrifuge has a bowl angle of four degrees or less and a low fluid depth of two inches or less. The fluids/solids separation device may comprise a shale shaker and/or a main centrifuge for example. The output material may have a relatively high initial solids content, such as 50% or more.

20 Claims, 7 Drawing Sheets

(56) References Cited

U.S. PATENT DOCUMENTS

2008/0230491 A1 9/2008 Wick
2012/0080185 A1* 4/2012 Jackson et al. ..... 166/267
2013/0012372 A1* 1/2013 Wick ..... 494/37
2013/0200007 A1* 8/2013 O'Konek et al. ..... 494/37

* cited by examiner

METHODS FOR REMEDIATING DRILL CUTTINGS AND OTHER PARTICULATE MATERIALS

CROSS-REFERENCE TO RELATED APPLICATION

This application is a continuation of U.S. application Ser. No. 12/052,634 filed on 20 Mar. 2008, which issued as U.S. Pat. No. 8,287,441 on 16 Oct. 2012, and claims the benefit under 35 U.S.C. §119 of U.S. application No. 60/896,818 filed 23 Mar. 2007 which is hereby incorporated herein by reference.

FIELD OF THE INVENTION

This invention relates to removing oily residues from particulate materials. The methods and apparatus may be applied to separating oil-based drilling fluids from drill cuttings.

BACKGROUND

Drilling fluids are used in drilling deep wells, such as wells for extraction of oil or natural gas. The drilling fluids help to keep the well bore open and also flush cuttings made by the drill bit to the surface. In a typical drilling operation, drilling fluid (also called drilling mud) is pumped down through the bore of a drill string to a drill bit. The drilling fluid exits through apertures in the drill bit and returns to the surface in an annular space between the drill string and a wall of the drill bore. The drilling fluid carries with it cuttings of rock or other material that is being drilled through.

At the surface, the cuttings are separated from the drilling fluid so that the drilling fluid may be reused. This separation may occur in several stages. In a typical operation, the drilling fluid is first passed through a shale shaker. The shale shaker comprises a vibrating screen. Large cuttings do not pass through the screen whereas the drilling fluid and small particles pass through the screen. The drilling fluid is then typically passed through a centrifuge. In most cases the centrifuge is a horizontal decanter-type centrifuge. The centrifuge separates smaller particulate solids from the drilling fluid. The drilling fluid is then returned to a tank from which it can be reused.

Various types of drilling fluid are used. Oil-based drilling fluids are used in some circumstances. Such oil-based drilling fluids have properties that are desirable in some applications. One difficulty that occurs, particularly with oil-based drilling fluids, is that the separation of particles from the drilling fluid is not perfect. Particles that have been separated by a shale shaker or a centrifuge typically carry some drilling fluid with them. Oily materials can constitute environmental hazards. In most jurisdictions it is not legal to dump cuttings or other soil which is contaminated with oil. Thus, disposing of cuttings in cases where an oil-based drilling fluid has been used can be very expensive.

In some cases, the oil content of the cuttings is sufficiently high that regulations govern the transportation of the cuttings. Such regulations can require that the cuttings be mixed with sawdust or another oil-absorbent material to prevent the release of oil during shipment. This adds significantly to the expense of transportation and also increases the volume of material to be disposed of, thus compounding a problem.

It is common practice to truck cuttings to a storage area and to store the cuttings until such time as somebody finds a practical way to remediate the cuttings by removing or breaking down the oil which coats the particles of the cuttings. The existence of such storage areas is a significant potential liability.

Various methods for removing oils from soil or other similar materials have been proposed in the literature. Some such methods are economically impractical and others do not work.

There is a need for cost-effective, practical methods and apparatus able to remove oils from soils and other similar materials. There is a particular need for such methods and apparatus that are suitable for alleviating the problems described above.

BRIEF DESCRIPTION OF THE DRAWINGS

The accompanying drawings illustrate non-limiting embodiments of the invention.

DETAILED DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Figure 1:
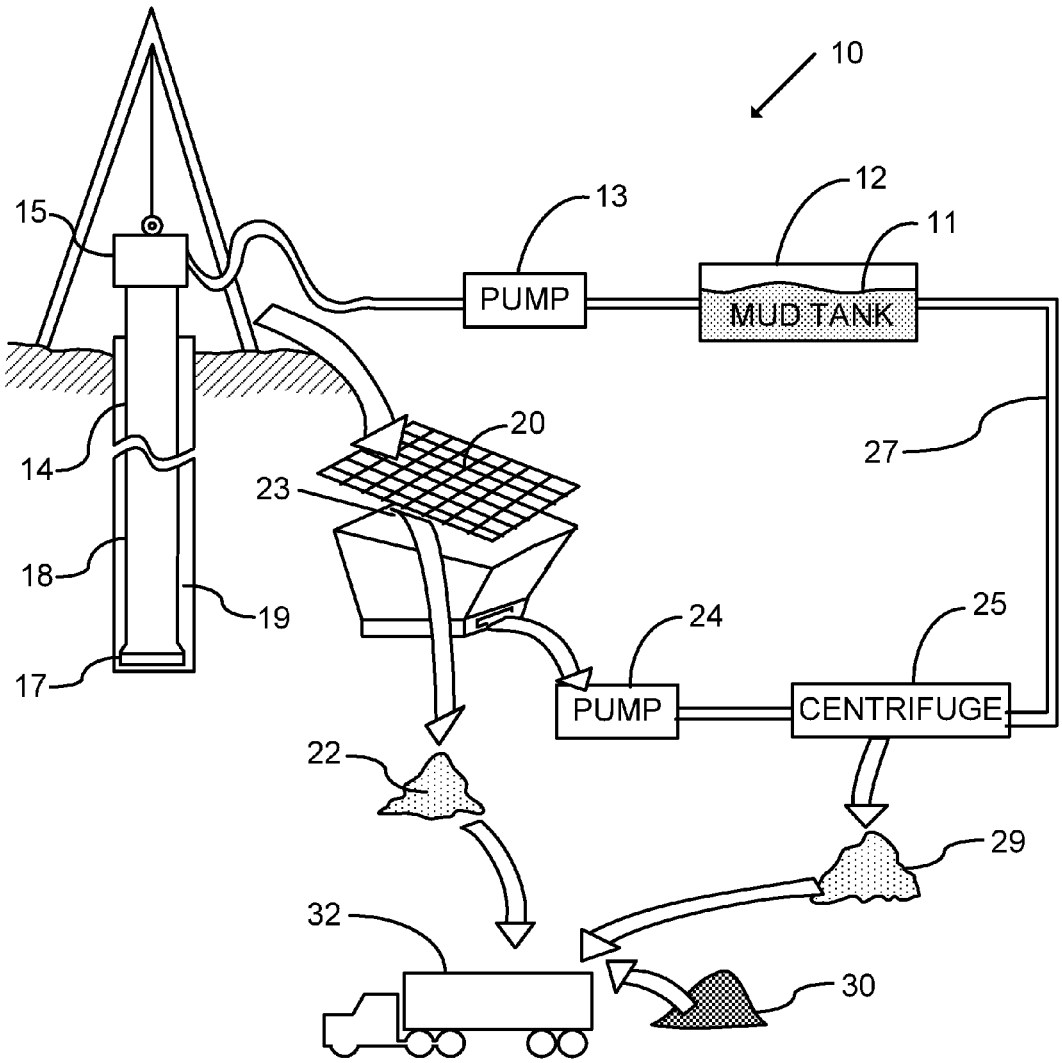
FIGURE 1 (PRIOR ART)
FIG. 1 is a schematic illustration of a prior art drilling operation.

FIG. 1 shows a typical prior art drill rig 10. Drill rig 10 has a mud tank 12 containing drilling fluid 11. The drilling fluid 11 is pumped through a pump 13 into a drill string 14 by way of swivel 15. The drilling fluid passes downward through a bore 18 in drill string 14 to a drill bit 17. As the drill bit 17 cuts away at rock or other material, drilling cuttings are carried upwardly by the drilling fluid though an annular space 19 surrounding drill string 14.

After the drilling fluid reaches the surface, it is passed through a shale shaker 20. Larger particles of cuttings do not pass through shale shaker 20 and are removed as solids 22 at a solids output 23. Fluids and smaller particles which pass through shale shaker 20 are pumped by pump 24 to a centrifuge 25. The centrifuge 25 separates some suspended solids 29 from the drilling fluid 11. Drilling fluid 11 is then returned to mud tank 12 by way of conduit 27.

The separated solids 22 and 29 are then mixed with a material such as sawdust 30 and loaded into a truck 32 for transportation to a storage and treatment location.

Figure 2:
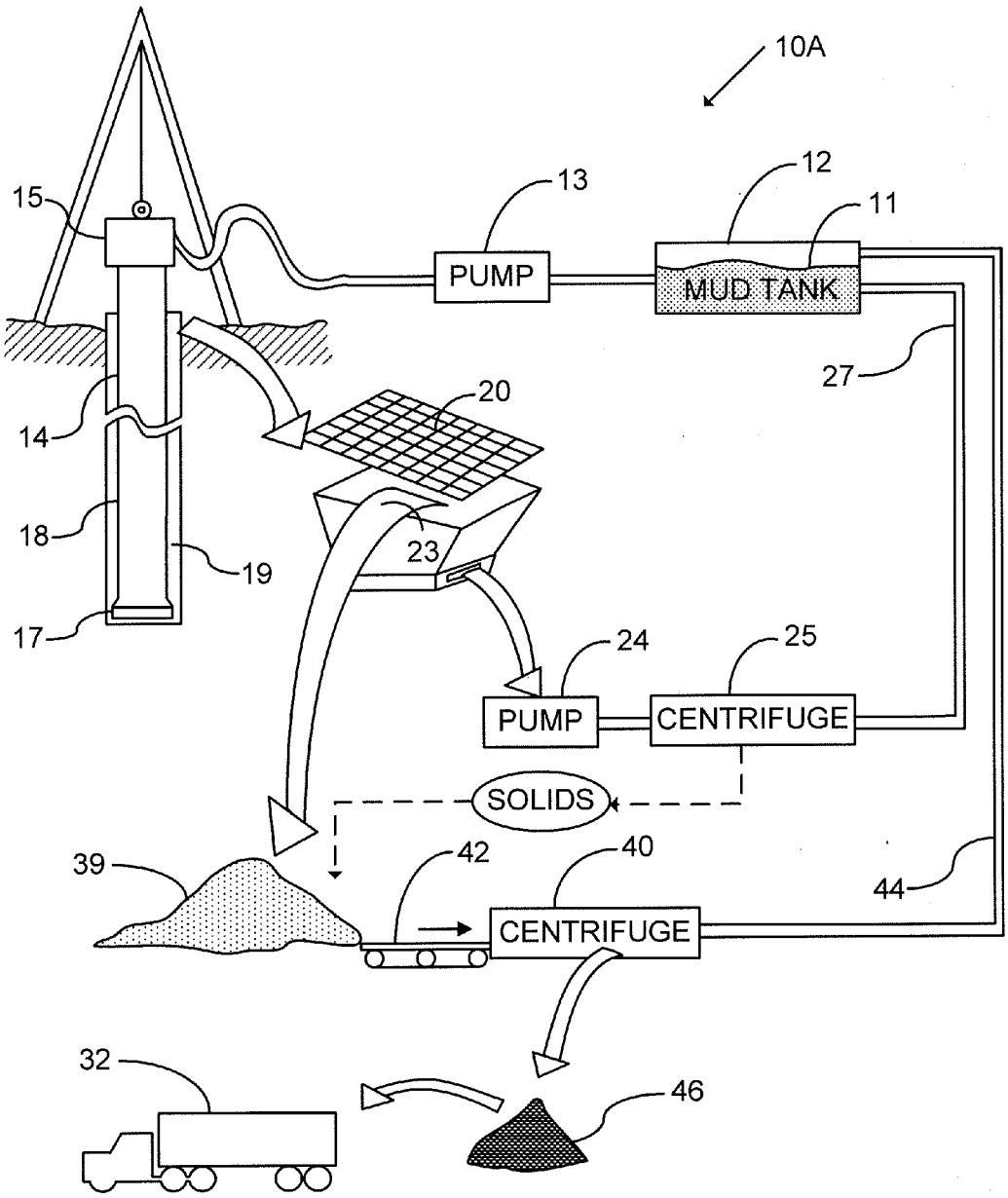
FIG. 2 is a schematic diagram of a drilling operation implementing a method for remediating drilling cuttings according to the invention.

FIG. 2 shows a drill rig 10A modified according to an embodiment of the invention. Apparatus which is common to FIGS. 1 and 2 is identified by the same reference numerals in FIG. 2 as in FIG. 1. In the embodiment of FIG. 2, solids output by shale shaker 20 and centrifuge 25 are collected. The collected solids 39 are passed to a second centrifuge 40 by way of a material conveyor 42. It is convenient but not mandatory that the collected solids 39 be passed directly to second centrifuge 40 by a material conveyor. In some embodiments, collected solids 39 are conveyed to second centrifuge 40 by a loader or other material carrier. It is also possible to stockpile collected solids 39 and process the collected solids 39 in batches periodically.

Second centrifuge 40 removes further drilling fluid from the collected material 39. In the illustrated embodiment, the drilling fluid removed by second centrifuge 40 is returned to mud tank 12 by way of conduit 44. The drilling fluid could instead be collected and reused in some other manner. Solids 46 output by second centrifuge 40 have a significantly reduced oil content as compared to solids 39. Solids 46 may, in many cases, be loaded directly into a truck 32 for transportation to a storage facility with reduced risk that any oil will escape during transportation to the storage facility. In some embodiments, solids 46 have a liquid content of 8% to 12% or less.

It can be seen from FIG. 2 that second centrifuge 40 is connected in series with first centrifuge 25 in the sense that the solids output from first centrifuge 25 are passed through second centrifuge 40. The material at the input of second centrifuge 40 may have a relatively high solids content. For example, the material at the input of second centrifuge 40 may have a solids content in excess of 50%, in some embodiments, 60%, or even 70%, or more (as much as 90% in some cases).

Figure 3:
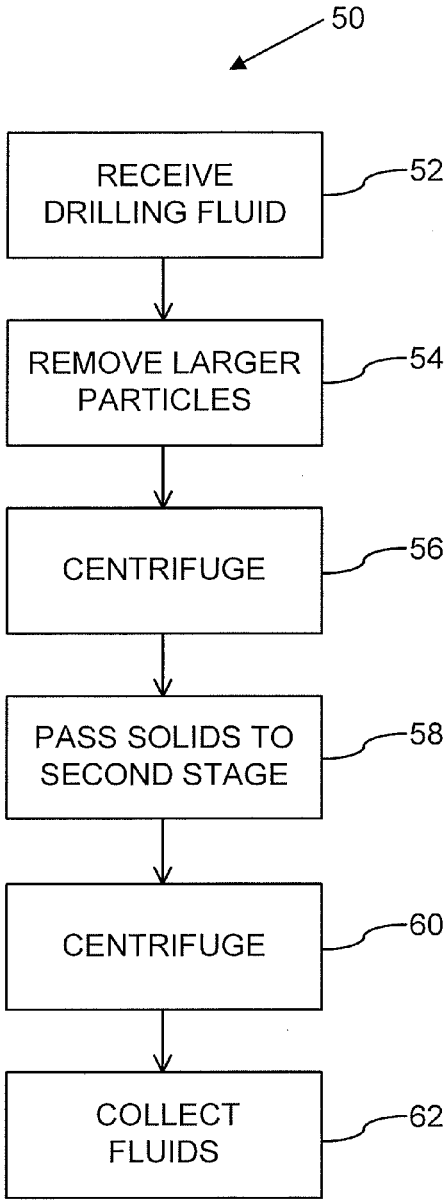
FIGS. 3 and 3A are flow diagrams illustrating methods according to example embodiments of the invention.

FIG. 3 shows a method 50 according to one embodiment of the invention. At block 52, method 50 receives drilling fluid containing cuttings. In optional block 54 larger particles are removed from the cuttings, for example by way of a shale shaker. In block 56 the drilling fluid is subjected to a first centrifuging step. In block 58 the solids separated from the drilling fluid in first centrifuging step 56 are passed to a second stage. In block 60 the second stage solids are subjected to a second centrifuging step. In block 62 the fluids from the second centrifuging step are collected. The collected fluids may be reused.

Collecting and reusing drilling fluid that would otherwise be disposed of with drilling cuttings can provide a significant cost savings because drilling fluids can be expensive. Collecting more of the drilling fluid permits both a higher recovery of costs and reduces the contamination of solid material that is removed from the drilling fluid in second centrifuging step 60.

First centrifuging step 56 and second centrifuging step 60 may optionally be carried out by the same centrifuge (at different times). However, in a preferred embodiment, different centrifuges are used for steps 56 and 60. In particular, it can be advantageous to adapt the centrifuge used for second centrifuging step 60 to treat materials high in solids content. In some embodiments the solids passed to the second stage in block 58 have a relatively high solids content compared to the solids content of material that is typically passed to a centrifuge for centrifugal separation. In some embodiments, the solids content of the solids passed to the second stage in block 58 is at least twice as great as the solids content of the material centrifuged in block 56. In some embodiments the solids content of the solids passed to the second stage in block 58 is three or more, in some cases four or more times as great as the solids content of the material centrifuged in block 56. This ratio can be even greater in some cases, especially where the material centrifuged in block 56 has a relatively low solids content.

Figure 3A:
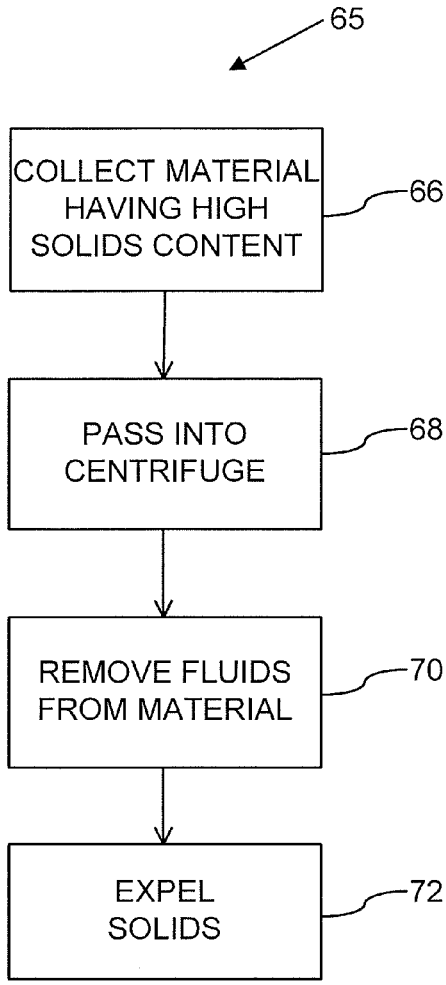

FIG. 3A shows a method 65 according to another embodiment of the invention. Method 65 begins at block 66 by collecting material that has a high solids content. In this context, high solids content means a solid content of at least 50% and, in some embodiments, 60%, or 70%, or more. The high solids content material is passed into a centrifuge in block 68. In some embodiments, block 68 comprises carrying the high solids content material into a centrifuge by way of a mass conveyor, such as an auger. Where the centrifuge used in block 68 is an axially-fed centrifuge, such as a horizontal decanter-type centrifuge, then the mass conveyor may comprise an auger that extends axially relative to the centrifuge. In block 70, fluids are removed from the high solids content material by centrifugation. Solids are expelled in block 72. Fluids removed from the material of block 70 may be collected for reuse.

Figure 4:
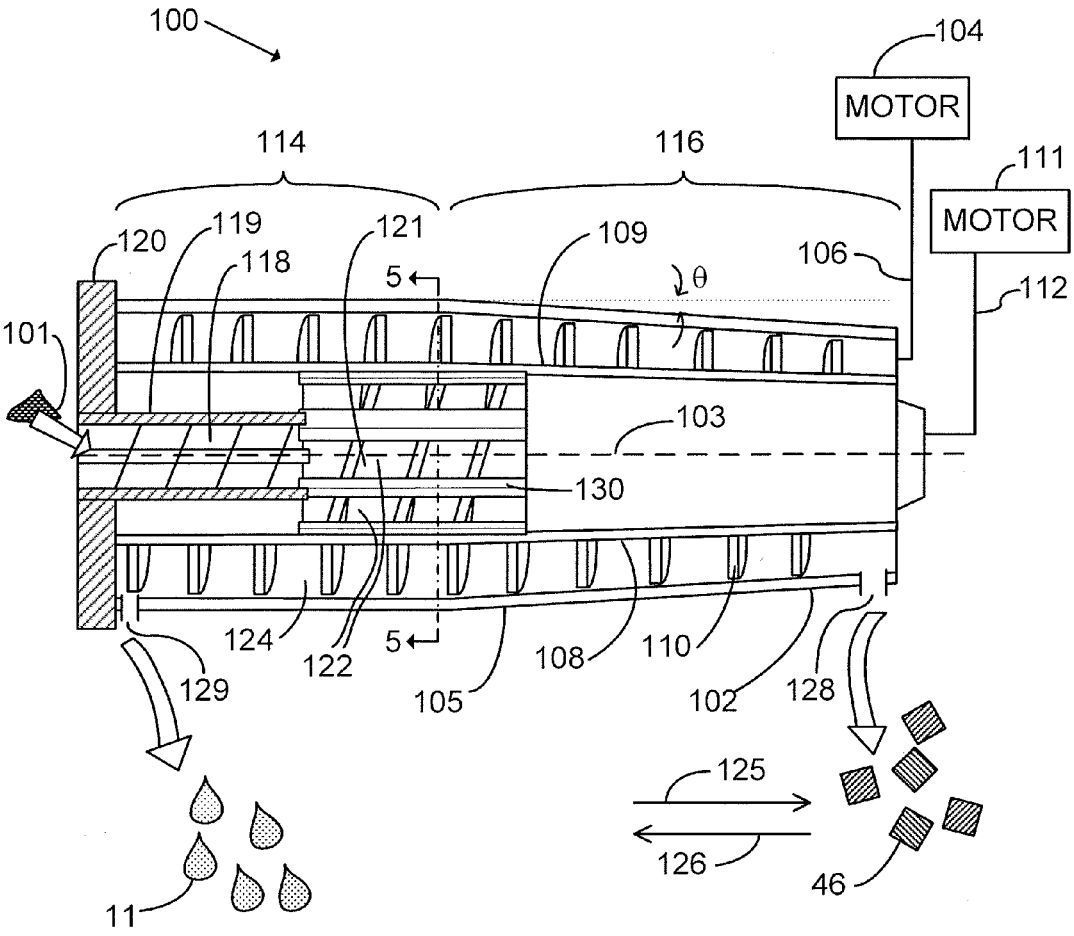
FIG. 4 is a cross section through a horizontal decanter-type centrifuge adapted according to an embodiment of the invention.

FIG. 4 is a partially schematic view of a centrifuge 100 adapted for separating liquids, such as oil-based drilling fluid, from an in-feed material having a relatively high solids content (e.g. a solids content of 50% or more, or in some cases, 60% or more or 70% or more). Centrifuge 100 comprises a drum 102 which can be driven for rotation about its axis 103 by a motor 104 and a suitable transmission 106. Drum 102 is housed inside drum housing 105. An auger 108 comprising a hollow shaft 109 supporting auger flights 110 is disposed inside drum 102. Auger 108 can be rotated about axis 103 at a rate that is slightly different from the rate of rotation of drum 102. In the illustrated embodiment, auger 108 is driven by a separate motor 111 via a suitable transmission 112. Alternative arrangements for driving drum 102 and auger 108 could be provided. For example, drum 102 and auger 108 could be driven by a single motor by way of suitable transmissions that cause drum 102 and auger 108 to rotate at different rates about axis 103.

Material 101 is introduced into centrifuge 100 by way of an in-feed auger 118 which carries the material into centrifuge 100 through an axial conduit 119. In an example embodiment, auger 118 has a diameter of 4 inches. In another example embodiment, auger 118 has a diameter in the range of about 4 inches to about 6 inches. In the illustrated embodiment, conduit 119 passes through the bore of bearings 120 that support drum 102 for rotation. The material is delivered to a bore 121 of hollow shaft 109. From there, the material can exit through apertures 122 into a volume 124 between shaft 109 and housing 105.

A feed mechanism 130 may be used to encourage the material to move from bore 121 to volume 124 without plugging. The feed mechanism may, for example, comprise a suitable cage-feed, spider-feed or bar-feed mechanism of types known in the art. Due to the high solids content of the material entering centrifuge 100, it is preferable to provide a feed mechanism that has large passages (e.g. large apertures 122) to make it unlikely that the feed mechanism will become plugged with material.

Figure 5:
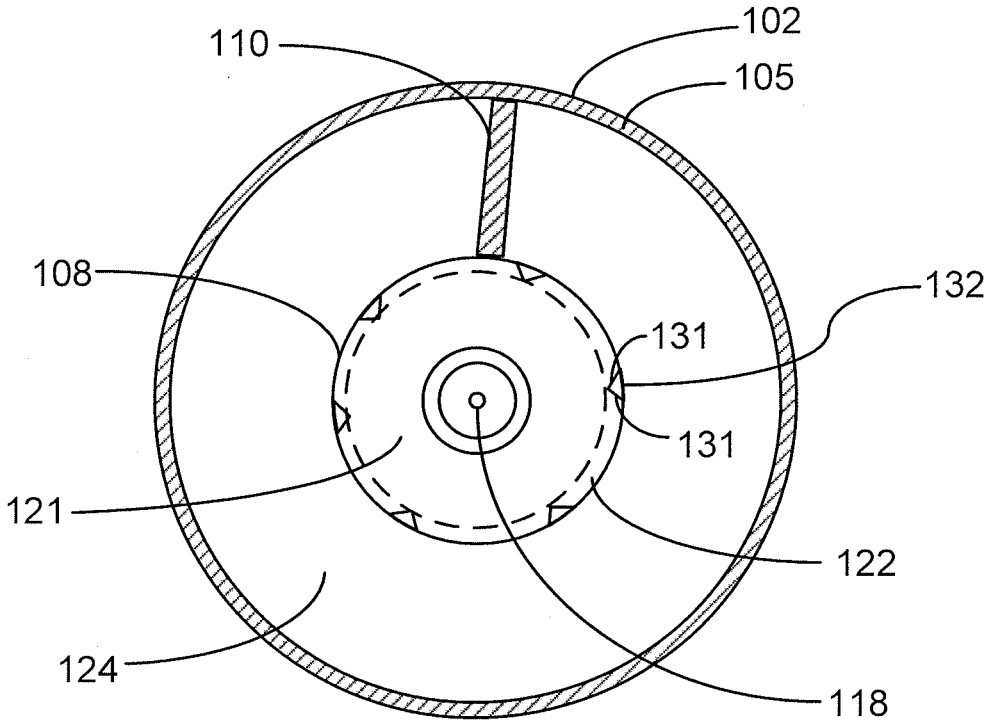
FIG. 5 is an alternate cross sectional view of the horizontal decanter-type centrifuge shown in FIG. 4.

FIG. 5 illustrates a cross section of centrifuge 100 through plane 5-5 in FIG. 4. Feed mechanism 130 comprises apertures 122 cut through the walls of an axial portion of auger 108. In the embodiment illustrated by FIGS. 4 and 5, apertures 122 are rectangular in shape. Edges 131 of segments 132 of the walls of auger 108 remaining between apertures 122 may have a slope which facilitates the exit of particles of material through apertures 122 into volume 124. In the illustrated embodiment, edges 131 slope toward each other so that they meet and form a peak pointing toward the centre of auger 108. Other shapes may be used to facilitate the exit of particles through apertures 122. For example, segments 132 may have convex curved inner walls.

In a region 114, the inner wall of housing 105 is substantially cylindrical. Drum 102 has a tapered portion 116 in which the radius of drum 102 decreases as one moves in direction 125. Flights 110 of auger 108 are shaped to conform to the contours of drum 102. There is a very small clearance between flights 110 and the inside of housing 105. As a result, the rotation of auger 108 tends to sweep any particles of material along centrifuge 100 in direction 125.

In the embodiment illustrated in FIG. 4, the particles of material are carried by auger 118 through region 114 to a region in bore 121 of auger 108 which is intermediate the opposing ends of centrifuge 100. preferably the particles are delivered in bore 121 near a region in drum 102 where region 114 meets tapered portion 116. In another embodiment, which is not illustrated, auger 118 may enter centrifuge 100 from tapered portion 116. The particles of material first pass through tapered portion 116 as they are carried in auger 118 and delivered to a region in bore 121 which is near where tapered portion 116 meets region 114. After the particles are delivered to bore 121, the particles exit bore 121 through apertures 122 and move into volume 124.

As particulate material in volume 124 is carried by auger 108 in a direction 125 it begins to move radially inwardly along the inside surface of housing 105 when it reaches region 116. Any liquid that is coating or otherwise associated with the particles experiences a radially-outward force which, because of the inward slope of the walls of housing 102 in region 116 tends to cause the liquid to flow in a direction 126 which is opposite to direction 125. Because auger 108 urges particles of solid material in direction 125 while the centrifugal forces acting on the liquids tend to cause the liquids, which can flow between flights 110 and housing 105, to flow in direction 126, a separation of the solids from the liquids occurs in region 116. Solids are carried to the end of drum 102 where they exit through openings 128. Liquids exit drum 102 at the other end of the centrifuge at openings 129. The liquids can be captured for reuse. The solids can be collected for disposal.

In some embodiments, flights 110 are closer together in region 114 and are farther apart in region 116. This can help to move fine particles out of the fluid that collects in region 114. In an example embodiment, flights 110 are arranged to provide a double lead in region 114 and to provide a single lead in region 116. The double lead may, for example, provide flights spaced apart by four inches while the single lead provides flights spaced apart by eight inches.

Many of the features of centrifuge 100 are conventional and may be varied in any suitable manner. One area in which centrifuge 100 differs from conventional horizontal decanter type centrifuges is the provision of infeed auger 118 which carries materials having a relatively high solids content into centrifuge 100. Another area in which centrifuge 100 may differ from prior centrifuges is in the angle θ made by the outer wall of drum 102 to axis 103 in tapered region 116 (this angle may be called the bowl angle). In most centrifuges, θ is at least 4° and may be 6° or more. In some embodiments of this invention, θ is significantly smaller. For example, in some embodiments of the invention θ is less than 4°. θ is in the range of ½° to 3.5° in some embodiments. In some embodiments θ is approximately 2°. In some embodiments θ is 2°±½°.

Another adaptation that centrifuge 100 may have to facilitate separation of liquids from high-solids-content infeed material is a shallow fluid depth. The fluid depth in region 114 is determined by the positions of openings 129.

Having a low angle θ is thought by the inventor to assist in separating liquids from solids because, with a small angle θ, especially in combination with a shallow fluid depth, region 116 can be longer such that particles spend more time in region 116 before exiting centrifuge 100 than they would do if angle θ were steeper. In some embodiments, openings 129 are positioned to provide a fluid depth of 2½ inches or less. The fluid depth may be, 2 inches, 1 inch or ¾ inches in example embodiments. In some embodiments, the fluid depth is in the range of ¾ inches to 2 inches.

In some embodiments, region 116 has the length of at least 40 inches. In example embodiments, region 116 has a length of 45 to 80 inches. In some embodiments, region 114 is shorter than region 116 and region 116 may have a length of at least 70% of a length of drum 102.

In some embodiments, the radius of drum 102 reduces by at least 15% between the point at which particles enter region 116 and the point at which particles exit region 116 (in the illustrated case, at exit openings 128).

In the illustrated embodiment, centrifuge 100 is horizontal. Axis 103 is horizontal to within ±5°. An auger 118 or other material conveyor may be provided in the context of a horizontal decanter-type centrifuge having features which are otherwise known in the art or may be provided in combination with a centrifuge having a small angle θ in region 116, as described above.

In preferred embodiments of the invention, the solids content of material exiting centrifuge 100 at openings 128 is greater than 85%. In many areas, this solids content is high enough (or conversely, the liquids content is low enough) that it is permissible to ship the materials directly in a truck without mixing them first with sawdust or other liquid-absorbing materials. This reduces the volume of material that must be carried away to a storage and/or treatment location and also renders the material more environmentally benign by removing more liquids which would otherwise be considered to be pollutants. Ideally the fluid content of the solid material exiting centrifuge 100 is less than 10%.

Liquids which are removed from centrifuge 100 at openings 129 may include oils that can be reused in oil-based drilling fluids or used in the formulation of oil-based drilling fluids. Such recovered oils are a valuable by-product. Ideally the liquids removed at openings 129 have a solids content not exceeding about 5%.

The efficiency with which a centrifuge 100 can perform separation may be increased by increasing the temperature of the material being treated by centrifuge 100. Centrifuge 100 may be operated in areas which could have explosive atmospheres. It is therefore desirable that any system provided to heat the materials being treated in centrifuge 100 be designed without open flames or other sources of ignition. In some embodiments, heating is provided by circulating hot air and/or hot fluids (e.g. hot water, glycol, or mixtures thereof). The air and/or fluids may be heated electrically, for example.

In some embodiments, heat is applied to one or more of:

housing 105;

conduit 119 and/or auger 118; and a feed funnel or conveyor through which the material to be treated passes to infeed auger 118.

The heat may be supplied, for example, by:

passing a heated fluid or gas through coils, a suitable heating jacket or other passages such that the heated fluid comes into thermal contact with the material to be treated;

providing electrical heating elements in thermal contact with the material to be treated; and/or the like.

Thermal contact may be made through a wall of centrifuge 100 or its associated apparatus or more directly with the material to be treated.

Advantageously, by the time it has reached apertures 122 or feed mechanism 130 the material to be treated is at a temperature in excess of 95° F., preferably at least 120° F., and more preferable at least 150° F. Where glycol is used as a heat transfer agent, the glycol may be heated, for example, to a temperature in the range of 200° F. to 300° F. and then circulated to warm the incoming material and centrifuge 100. In some embodiments, the glycol or other heat exchange fluid is heated by an electrical heating element which may be an immersion-type heating element.

It can be beneficial to heat the incoming material at or near to the inlet of centrifuge 100. If the incoming material is heated too early then some oil may separate from the material before the material reaches centrifuge 100. In some cases this could result in leakage of oil or interfere with the operation of a material conveyor 42 or other apparatus for delivering material to centrifuge 100. In an example embodiment, heating is provided both around housing 105 and around conduit 119 and/or auger 118. In some embodiments, material to be treated is also heated at or in a first centrifuge 25.

Figure 6:
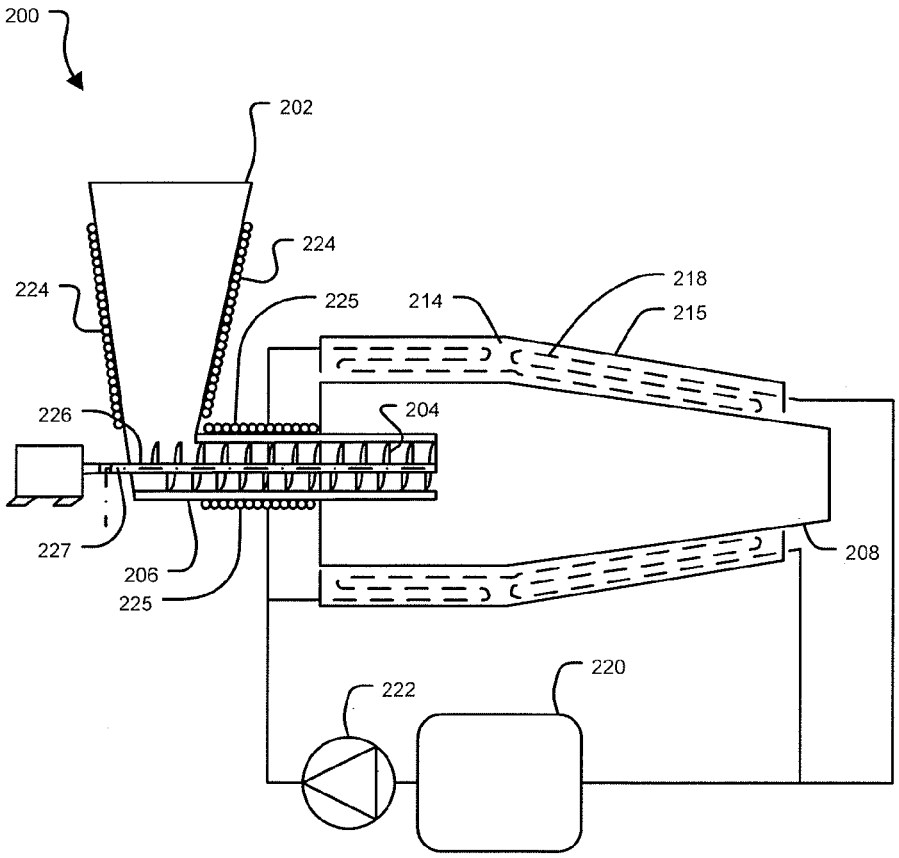
FIG. 6 is a schematic illustration of a horizontal decanter-type centrifuge according to an embodiment of the invention equipped with a heating system.

FIG. 6 shows schematically a centrifuge 200 that includes a heating system. Centrifuge 200 includes a feed funnel 202 that receives material to be treated. Feed funnel 202 delivers the material to an infeed auger 204 that passes through a conduit 206. Conduit 206 extends into the rotating drum 208 of centrifuge 200. Centrifuge 200 may operate in the same or substantially the same way as centrifuge 100, which is described above.

A heating jacket 214 surrounds drum 208. Heating jacket 214 may comprise an insulated wall 215. Heating elements 218 are provided within heating jacket 214. The heating elements in the illustrated embodiment include coils of tubing. A heater 220 heats a heat exchange fluid. The heat exchange fluid is circulated though heating elements 218 by a circulation pump 222. In the illustrated embodiment additional heating elements are provided. In particular:

- heating elements 224 are provided on the walls of feed funnel 202;
- heating elements 225 are provided on the wall of conduit 206; and,
- heating elements 226 are provided within a shaft 227 of infeed auger 204.

In some embodiments, some or all of the heating is provided in other manners. For example, heating may be provided by electrical heating elements or by mechanical friction. In some embodiments, drum 208 is heated by mechanical friction between drum 208 or a member that rotates with drum 208 and a stationary member.

Figure 7:
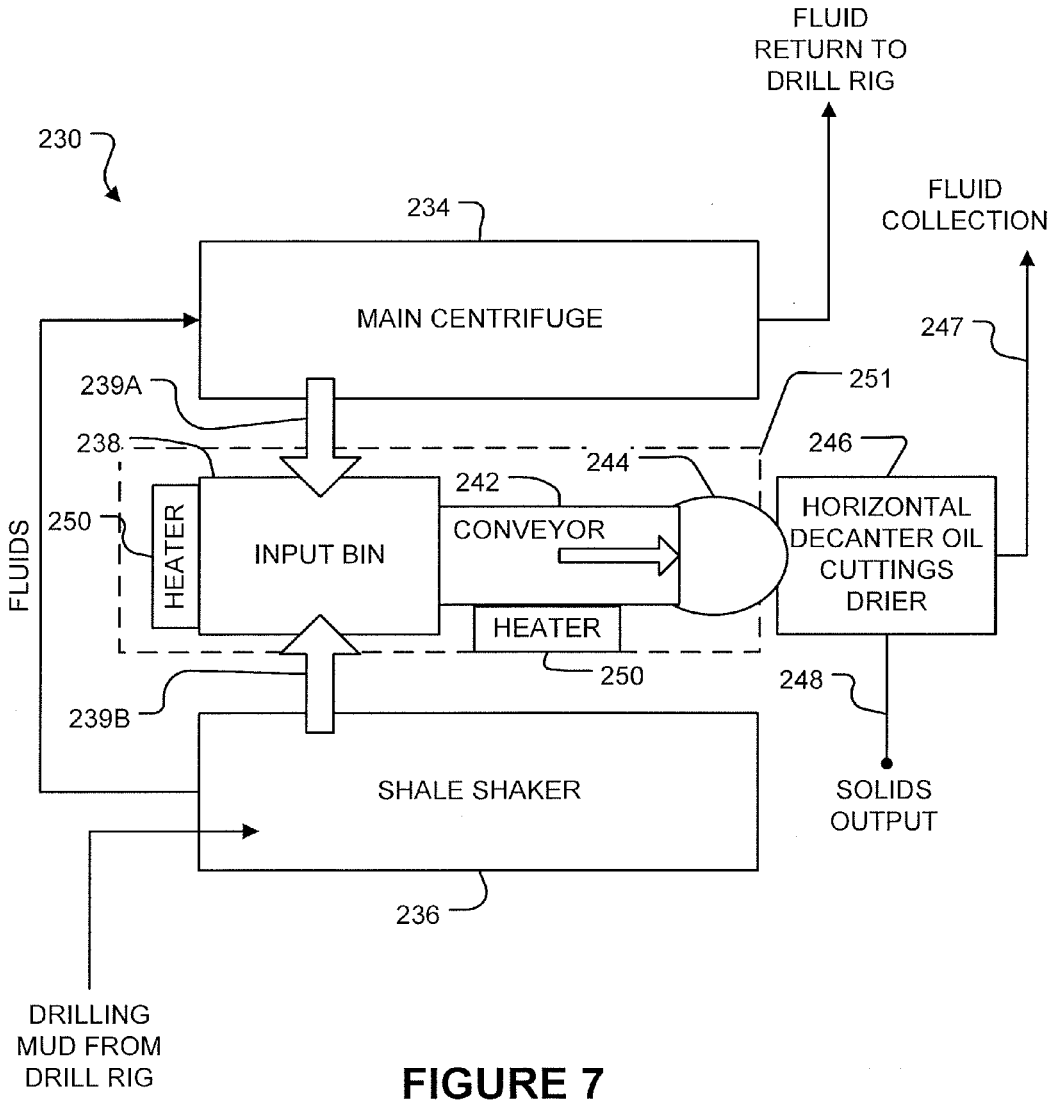
FIG. 7 shows an advantageous layout for apparatus according to an embodiment of the invention.

FIG. 7 shows one advantageous arrangement for apparatus 230 according to an example embodiment of the invention. Apparatus 230 comprises a main centrifuge 234 and a shale shaker 236 arranged on either side of an input bin 238. Solids 239A from main centrifuge 234 and solids 239B from shale shaker 236 are both delivered into input bin 238.

A conveyor 242 carries the solids to a feed funnel 244 of a horizontal decanter-type centrifuge 246 that serves as a horizontal decanter oil cuttings drier to separate oils from the solids as described above. Oils may be returned to a drill rig or other collection point for reuse in drilling fluid by a fluid output line 247. Solids having much reduced oil content are delivered by solids output 248 to a collection point from which the solids can be loaded for transport.

The arrangement illustrated in FIG. 7 is advantageous because it permits operation with or without centrifuge 246. When centrifuge 246 is not present or is not operational because it is being serviced or the like then operation can continue with solids 239A and 239B being collected in input bin 238. The solids can be allowed to collect in bin 238 until centrifuge 246 is back online or can be handled in a manner known in the prior art while centrifuge 246 is not present or not operational.

In some embodiments, heaters 250 are provided to preheat material in input bin 238 and or material being delivered by conveyor 242. For example, heaters 250 may be applied to heat the structures of input bin 238 and/or conveyor 242. For example, the heaters may heat the walls and/or floor of input bin 238 and/or the structure of conveyor 242. In some embodiments, input bin 238 and/or conveyor 242 may be located inside an insulated structure 251 to conserve heat.

Apparatus 230 can be conveniently located in close proximity to a drill rig.

The various aspects of the invention described herein may be used independently of one another. For example:

- The methods for processing drilling fluids which involve feeding the solids output by one centrifuge and/or a shale shaker into a second centrifuge may be practiced without using the specific centrifuge designs described herein.
- A centrifuge may be provided with a feed auger 118 or other material conveyor to bring high-solids-content material into the centrifuge without having a low bowl angle and vice versa.
- A centrifuge may be provided with a heating system as described herein while differing in other design features from the example centrifuges described herein.
- The methods for removing liquids from high-solids-content materials by passing the high-solids-content materials through a centrifuge may be practiced without using the specific centrifuge designs described herein.

Features of different disclosed embodiments may be combined in combinations and sub-combinations other than those expressly described and depicted herein.

Where a component (e.g. a material conveyor, bearing, assembly, device, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

While a number of exemplary aspects and embodiments have been discussed above, those of skill in the art will recognize certain modifications, permutations, additions and sub-combinations thereof. The invention may be applied to separate oils from oily materials other than drill cuttings. For example, the invention may be applied to separate oils or oily materials from dirt in the event of oil spills or leaks.

What is claimed is:

1. A method for removing liquids from drilling fluid containing cuttings, the method comprising:

- passing an oil-based drilling fluid containing cuttings to an input of a solid/fluid separation device;
- processing the drilling fluid and cuttings in the solid/fluid separation device to provide a first output enriched in solids, the first output having a solids content of at least 50%, and a second output enriched in fluids;
- passing the first output of the solid/fluid separation device to an input of a centrifuge; and, processing the first output in the centrifuge to provide a third output enriched in solids relative to the first output and a fourth output enriched in liquids relative to the first output.

2. A method according to claim 1 wherein the centrifuge comprises a horizontal decanter-type centrifuge.

3. A method according to claim 1 wherein the solid/fluid separation device comprises a main centrifuge and the second output is an output of the main centrifuge.

4. A method according to claim 1 comprising heating the first output to a temperature of at least 100° F. before completing processing the first output in the centrifuge.

5. A method according to claim 4 wherein the centrifuge comprises a horizontal decanter-type centrifuge.

6. A method according to claim 5 wherein passing the first output of the solid/fluid separation device to the input of the centrifuge comprises carrying the first output along an infeed auger that is concentric with an axis of rotation of a drum of the centrifuge.

7. A method according to claim 6 wherein the solids/liquid separation device comprises a shale shaker and a main centrifuge each yielding a fluids output and a solids output enriched in solids relative to the fluids output and the method comprises delivering the solids outputs of the shale shaker and the main centrifuge to the input of the horizontal decanter-type centrifuge.

8. A method according to claim 7 comprising collecting the second and fourth outputs and recycling the second and fourth outputs as drilling fluid.

9. A method according to claim 5 comprising maintaining a fluid depth of 2 inches or less in the horizontal decanter-type centrifuge.

10. A method according to claim 5 wherein the horizontal decanter-type centrifuge comprises a rotating drum and the method comprises heating a wall of the drum.

11. A method for removing liquids from drilling fluid containing cuttings, the method comprising:

passing the drilling fluid and cuttings to an input of a solid/fluid separation device;

processing the drilling fluid and cuttings in the solid/fluid separation device to provide a first output enriched in solids and a second output enriched in fluids;

passing the first output of the solid/fluid separation device to an input of a centrifuge; and, processing the first output in the centrifuge to provide a third output enriched in solids and a fourth output enriched in liquids;

wherein the centrifuge comprises a horizontal decanter-type centrifuge and the method comprises passing the second output of the solid/fluid separation device to a main centrifuge, processing the second output of the solid/fluid separation device in the main centrifuge to provide a fifth output enriched in liquids and a sixth output enriched in solids, and passing the sixth output of the main centrifuge to the input of the horizontal decanter-type centrifuge.

12. A method according to claim 11 wherein the solid/fluid separation device comprises a screen.

13. A method according to claim 12 wherein the solid/fluid separation device comprises a shale shaker.

14. A method according to claim 13 comprising heating the first output to a temperature of at least 100° F. before completing processing the first output in the horizontal decanter-type centrifuge.

15. A method according to claim 14 wherein passing the first output of the solid/fluid separation device to the input of the horizontal decanter-type centrifuge comprises carrying the first output along an infeed conveyor that is concentric with an axis of rotation of a drum of the horizontal decanter-type centrifuge.

16. A method according to claim 15 comprising heating the first output as the first output is carried along the infeed conveyor.

17. A method according to claim 16 wherein the infeed conveyor comprises a conduit having a bore and the method comprises heating the conduit.

18. A method according to claim 16 wherein the first output has a solids content of at least 50%.

19. A method according to claim 18 wherein the third output has a solids content of 85% or more.

20. A method according to claim 19 comprising collecting the second and fourth outputs and recycling the second and fourth outputs as drilling fluid.

* * * * *